US010388482B2

(12) United States Patent
Siegwald et al.

(10) Patent No.: US 10,388,482 B2
(45) Date of Patent: Aug. 20, 2019

(54) MULTI-PART SYMMETRICAL FUSE ASSEMBLY

(71) Applicant: Littelfuse, Inc., Chicago, IL (US)

(72) Inventors: Nathan C. Siegwald, Tolono, IL (US); Dustin Kurtz, Paxton, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 15/862,790

(22) Filed: Jan. 5, 2018

(65) Prior Publication Data

US 2019/0214213 A1 Jul. 11, 2019

(51) Int. Cl.

| | |
|---|---|
| ***H01H 85/165*** | (2006.01) |
| ***H01H 85/055*** | (2006.01) |
| *H01H 85/175* | (2006.01) |
| *H01H 85/20* | (2006.01) |

(52) U.S. Cl.

CPC ..... *H01H 85/165* (2013.01); *H01H 85/055* (2013.01); *H01H 85/175* (2013.01); *H01H 85/1755* (2013.01); *H01H 85/2045* (2013.01)

(58) Field of Classification Search

CPC .. H01H 85/157; H01H 85/165; H01H 85/175; H01H 85/2045; H01H 85/055; H01H 85/1755

USPC ..... 337/186

See application file for complete search history.

(56) References Cited

U.S. PATENT DOCUMENTS 5,229,739 A * 7/1993 Oh ..... H01H 69/02 337/255
5,296,832 A * 3/1994 Perreault ..... H01H 85/153 337/158
5,426,411 A * 6/1995 Pimpis ..... H01H 85/153 29/623
2001/0026209 A1* 10/2001 Kondo ..... H01H 85/0417 337/260
2005/0035841 A1* 2/2005 Kobayashi ..... B23K 35/262 337/157
2012/0133478 A1* 5/2012 Chiu ..... H01H 85/165 337/228
2016/0141140 A1* 5/2016 Schmidt ..... H01H 69/02 337/187

(Continued)

FOREIGN PATENT DOCUMENTS

EP 0803889 A2 10/1997

OTHER PUBLICATIONS

Extended European Search Report for Application No. 19150064.4, dated Jun. 18, 2019, 10 pages.

*Primary Examiner* — Jacob R Crum

(57) ABSTRACT

Approaches herein provide a fuse assembly including a multi-part symmetrical housing. In some embodiments, the fuse assembly includes a core having a set of fusible elements extending between a first end fitting and a second end fitting, and a housing surrounding the core. The housing may include a first section having a first wall defining a first internal cavity, the first wall including a first slot and a first ridge, and a second section coupled to the first section, the second section having a second wall defining a second internal cavity. The second wall may include a second slot and a second ridge, wherein the first slot engages the second ridge and the second slot engages the first ridge. In some embodiments, the first and second sections define a set of openings for the first and second end fittings to extend therethrough.

12 Claims, 5 Drawing Sheets

(56) References Cited

U.S. PATENT DOCUMENTS

2016/0268089 A1* 9/2016 Schlaak ..... H01H 85/042
2017/0365434 A1 12/2017 Douglass et al.

* cited by examiner

MULTI-PART SYMMETRICAL FUSE ASSEMBLY

FIELD OF THE DISCLOSURE

The disclosure relates generally to the field of protection device components and, more specifically, to a multi-part symmetrical fuse body.

BACKGROUND OF THE DISCLOSURE

Fuses are overcurrent protection devices for electrical circuitry, and are widely used to protect electrical power systems and prevent damage to circuitry and associated components when specified circuit conditions occur. A fusible element or assembly is coupled between terminal elements of the fuse, and when specified current conditions occur, the fusible element or assembly, disintegrates, melts or otherwise structurally fails, and opens a current path between the fuse terminals. Line side circuitry may therefore be electrically isolated from load side circuitry through the fuse, preventing possible damage to load side circuitry from overcurrent conditions.

Fuses may be single or multiple-element, the later having performance advantages but being more complicated and costly to manufacture. This is due in part to having multiple parts, which requires complicated fixturing and increases the possibility for error. In view of these challenges, improvements in multiple element electrical fuses are desired.

SUMMARY

In one approach according to embodiments of the disclosure, a fuse assembly may include a core including a set of fusible elements extending between a first end fitting and a second end fitting, and a housing surrounding the core. The housing may include a first section having a first wall defining a first internal cavity, the first wall including a first slot and a first ridge, and a second section coupled to the first section, the second section having a second wall defining a second internal cavity, and the second wall including a second slot and a second ridge, wherein the first slot engages the second ridge and the second slot engages the first ridge.

In another approach according to embodiments of the disclosure, a fuse may include a core having a set of fusible elements extending between a first end fitting and a second end fitting, and a housing surrounding the core. The housing may include a first section having a first end wall and a first sidewall defining a first internal cavity, the first end wall including a first slot and a first ridge, and a second section coupled to the first section. The second section has a second end wall and a second side wall defining a second internal cavity, the second end wall including a second slot and a second ridge, wherein the first ridge extends into the second slot and the second ridge extends into the first slot.

In yet another approach according to embodiments of the disclosure, a square-body fuse may include a core including a set of fusible elements extending between a first end fitting and a second end fitting, and a housing surrounding the core such that the set of fusible elements are contained within the housing and the first and second end fittings extend partially outside of the housing. The housing may include a first section having a first end wall and a first sidewall defining a first internal cavity, the first end wall including a first slot and a first ridge. The housing may further include a second section coupled to the first section, the second section having a second end wall and a second side wall defining a second internal cavity, the second end wall including a second slot and a second ridge, wherein the first ridge extends into the second slot and the second ridge extends into the first slot.

BRIEF DESCRIPTION OF THE DRAWINGS

The accompanying drawings illustrate exemplary approaches of the disclosed embodiments so far devised for the practical application of the principles thereof, and in which.

Figure 1:
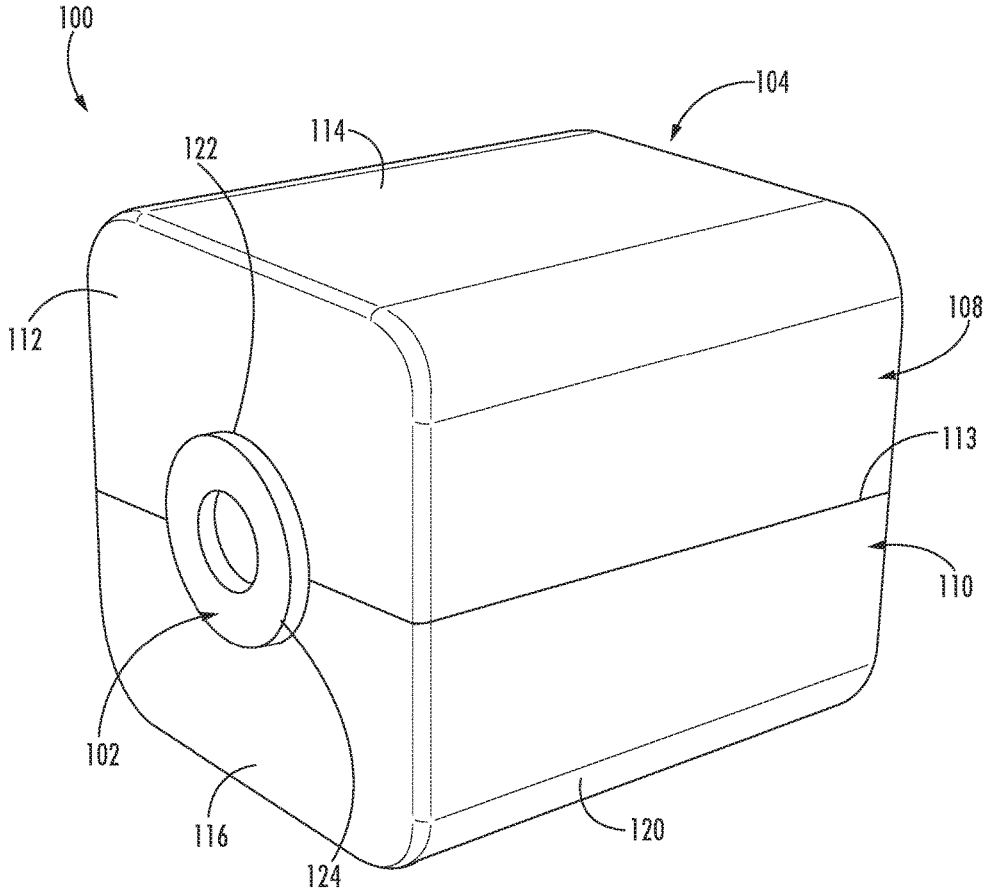
FIG. 1 is perspective view of a fuse assembly in accordance with embodiments of the present disclosure.

The drawings are not necessarily to scale. The drawings are merely representations, not intended to portray specific parameters of the disclosure. The drawings are intended to depict exemplary embodiments of the disclosure, and therefore are not be considered as limiting in scope. In the drawings, like numbering represents like elements.

Furthermore, certain elements in some of the figures may be omitted, or illustrated not-to-scale, for illustrative clarity. Still furthermore, for clarity, some reference numbers may be omitted in certain drawings.

DETAILED DESCRIPTION

Various approaches in accordance with the present disclosure will now be described more fully hereinafter with reference to the accompanying drawings, where embodiments of a device and method are shown. The device(s) and method(s) may be embodied in many different forms and are not be construed as being limited to the embodiments set forth herein. Instead, these embodiments are provided so this disclosure will be thorough and complete, and will fully convey the scope of the system and method to those skilled in the art.

For the sake of convenience and clarity, terms such as "top," "bottom," "upper," "lower," "vertical," "horizontal," "lateral," and "longitudinal" will be used herein to describe the relative placement and orientation of these components and their constituent parts, with respect to the geometry and orientation of a component of a semiconductor manufacturing device as appearing in the figures. The terminology will include the words specifically mentioned, derivatives thereof, and words of similar import.

As used herein, an element or operation recited in the singular and proceeded with the word "a" or "an" are understood as potentially including plural elements or operations as well. Furthermore, references to "one embodiment" of the present disclosure are not intended to be interpreted as precluding the existence of additional embodiments also incorporating the recited features.

Furthermore, in the following description and/or claims, the terms "on," "overlying," "disposed on" and "over" may be used in the following description and claims. "On," "overlying," "disposed on" and "over" may be used to indicate that two or more elements are in direct physical contact with each other. However, "on,", "overlying," "disposed on," and over, may also mean that two or more elements are not in direct contact with each other. For example, "over" may mean that one element is above another element but not contact each other and may have another element or elements in between the two elements. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect.

As will be described in detail herein, embodiments of the present disclosure include a fuse assembly including a multi-part symmetrical housing. In some embodiments, the fuse assembly includes a core having a set of fusible elements extending between a first end fitting and a second end fitting, and a housing surrounding the core. The housing may include a first section having a first wall defining a first internal cavity, the first wall including a first slot and a first ridge, and a second section coupled to the first section, the second section having a second wall defining a second internal cavity. The second wall may include a second slot and a second ridge, wherein the first slot engages the second ridge and the second slot engages the first ridge. In some embodiments, the first and second sections define a set of openings for the first and second end fittings to extend therethrough.

The fuse assembly of the present disclosure provides at least the following technical advantages over the prior art. Firstly, the symmetrical halves of the housing join together using significantly fewer parts. For example, the fuse assembly may use up to 16 fewer screws and no outer caps. Secondly, the fuse housing reduces assembly time and improves quality by eliminating the need to handle the core. For example, the core does not need to be moved from station to station and/or fed into the housing from the top. Thirdly, the fuse assembly may provide a cost reduction of approximately 20% (or more) over existing designs due to the reduction in number of parts.

Figure 2:
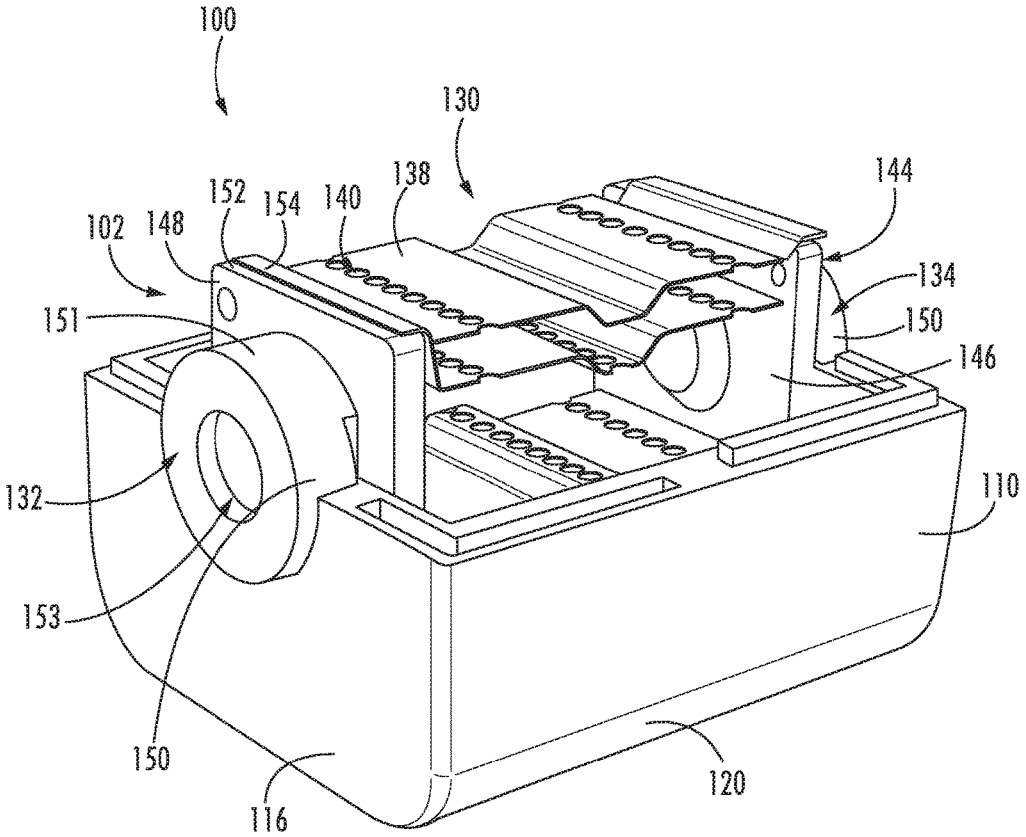
FIG. 2 is a perspective view of the fuse assembly of FIG. 1 with one portion of the housing removed in accordance with embodiments of the present disclosure.
Figure 3:
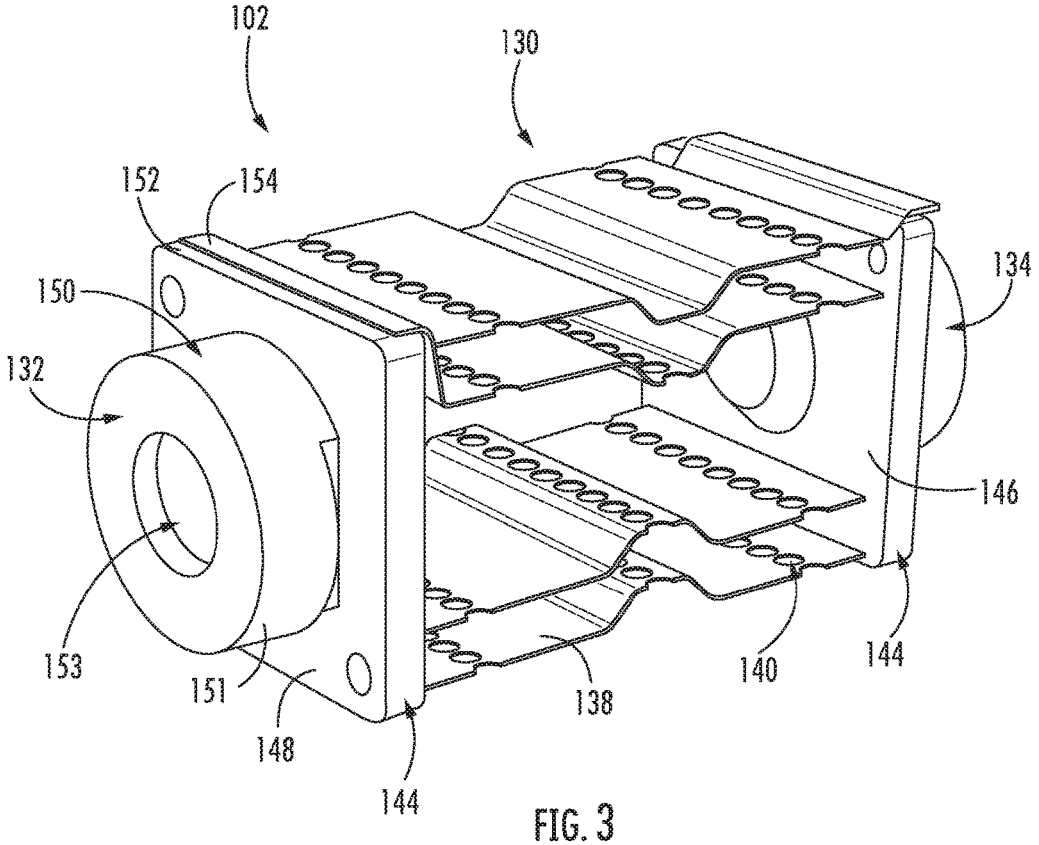
FIG. 3 is a perspective view of a core of the fuse assembly of FIG. 1 in accordance with embodiments of the present disclosure.

Referring now to FIGS. 1-3, a fuse assembly 100 according to some embodiments of the present disclosure will be described in greater detail. As shown, the fuse assembly 100 may be multi-part symmetrical square-body fuse, including a core 102 surrounded by a housing 104. The housing 104 may include two symmetrical halves, namely a first section 108 coupled to a second section 110 along a joint 113. As shown, the first section 108 may include a first end wall 112 integrally formed with a first sidewall 114. Similarly, the second section 110 may include a second end wall 116 integrally formed with a second sidewall 120. The first section 108 includes an opening 122 through the first end wall 112, and the second section 110 includes an opening 124 through the second end wall 116. The first and second openings 122, 124 are generally aligned, together providing a circular opening to permit the core 102 to extend therethrough. Although described primarily herein as a square-body fuse, it will be appreciated that other geometries/shapes for the housing 104 are possible within the scope of present disclosure.

As better shown in FIGS. 2-3, the core 102 may include a set of fusible elements 130 extending between a first end fitting 132 and a second end fitting 134. Each of the first and second end fittings 132, 134 may include a block section 144 having an internal surface 146 and an external surface 148, and an end section 150 extending from the external surface 148. The end section 150 may include an outer perimeter surface 151 and a central opening 153. As shown, the end section 150 may extend through the first opening 122 and the second opening 124 of the first and second end walls 112 and 116, respectively. In exemplary embodiments, the set of fusible elements 130 are contained within the housing 104 and the first and second end fittings 132, 134 extend partially outside of the housing 104.

As further shown, the block section 144 includes a perimeter surface 152, wherein a connector element 154 of the set of fusible elements 130 is directly physically/electrically coupled to the perimeter surface 152. In some embodiments, the block section 144 is substantially square shaped, while the end section 150 is substantially circular or tube shaped. Although not limited to any particular material, it will be appreciated that the first and second end fittings 132, 134 are electrically and thermally conductive.

In some embodiments, each of the fusible elements 130 may include a plurality of solid sections 138 joined together by electrically conductive bridges 140, which may include a set of openings provided therebetween. In various embodiments, the solid sections 138 and/or the electrically conductive bridges 140 may have a same or reduced thickness as compared to the connector elements 154. Furthermore, each of the fusible elements 130 may have a bent or curved shape to allow each of the fusible elements 130 to extend parallel, or substantially parallel, to one another between the first and second end fittings 132, 134. Each of the fusible elements 130 may have a portion having a smaller cross-section, and/or an area having a lower melting point, such as tin, silver, lead, nickel, or an alloy thereof. Although not shown, the housing 104 may include a filler adjacent the fusible elements 130.

Figure 4:
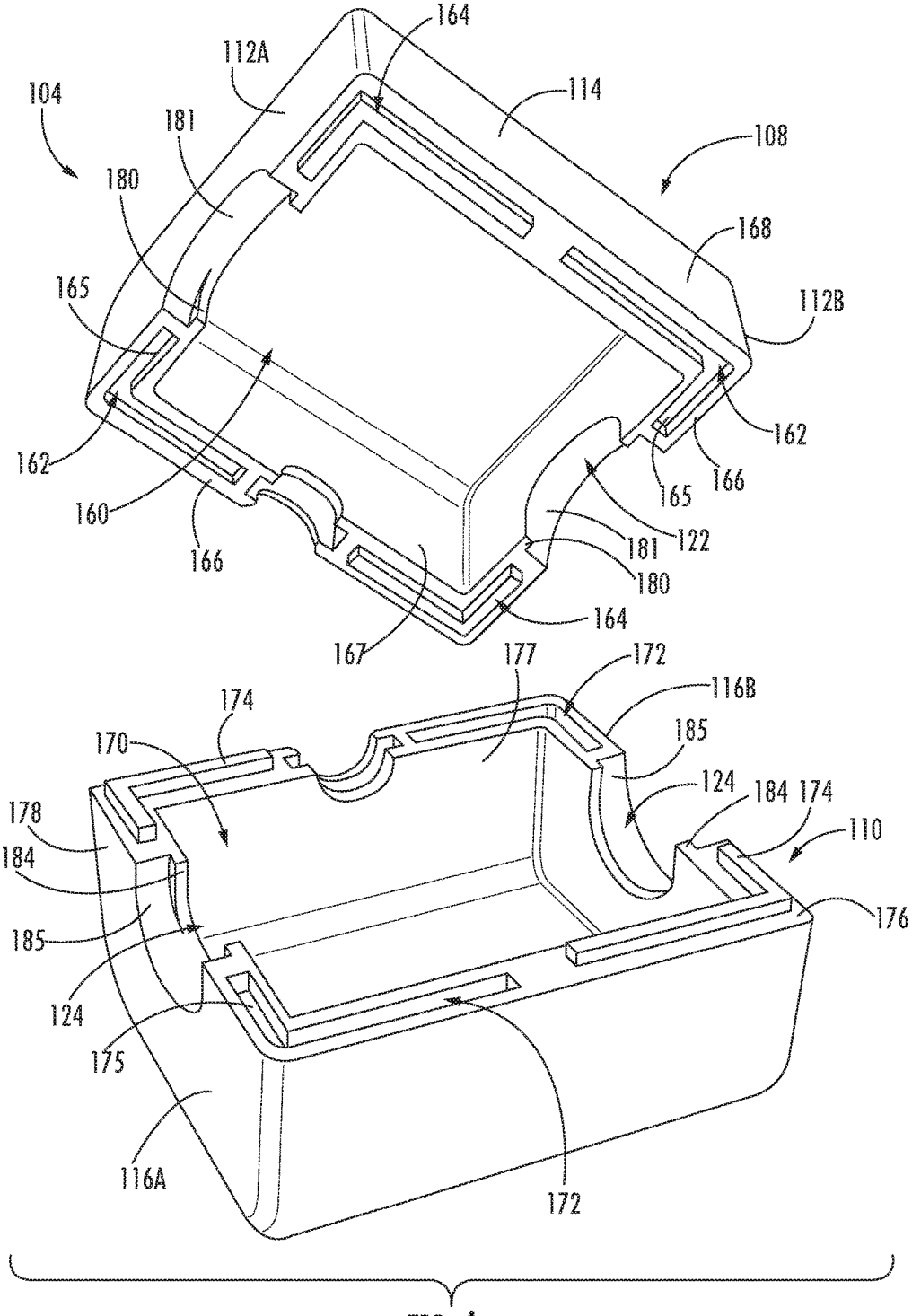
FIG. 4 is a perspective view of the housing of the fuse assembly of FIG. 1 in accordance with embodiments of the present disclosure.

Turning now to FIG. 4, the housing 104 of the fuse assembly 100 according to embodiments of the present disclosure will be described in greater detail. As shown, the housing 104 includes the first section 108 having a pair of first end walls 112A-B and the first sidewall 114, wherein the pair of first end walls 112A-B and the first sidewall 114 define a first internal cavity 160. The pair of first end walls 112A-B may include one or more first slots 162 and one or more first ridges 164. In the embodiment shown, the first slots 162 are generally L-shaped and located on opposite corners of the first section 108 relative to one another. Each of the first slots 162 may include a base surface 165 recessed below a perimeter face 166 extending around the first end walls 112A-B and the first sidewall 114. Similarly, the first ridges 164 are generally L-shaped and located on opposite corners of the first section 108 relative to one another. Each of the first ridges 164 may extend outwardly from the perimeter face 166 and towards the second section 110 of the housing 104. As shown, each of the first end walls 112A-B and the first sidewall 114 have a first inner surface 167 and a first outer surface 168, wherein the first slots 162 and the first ridges 164 extend between the first inner surface 167 and the first outer surface 168. Said another way, a plane defined by the first inner surface 167 and a plane defined by the first outer surface 168 may be oriented parallel, or substantially parallel to, the first slots 162 and the first ridges 164.

The first slots 162 and the first ridges 164 are provided to couple the second section 110 to the first section 108. More specifically, the second section 110 may have a pair of second end walls 116A-B at opposite ends of the second sidewall 120, wherein the second end walls 116A-B and the second sidewall 120 define a second internal cavity 170. The pair of second end walls 116A-B may include one or more second slots 172 and one or more second ridges 174. In the embodiment shown, the second slots 172 are generally L-shaped and located on opposite corners of the second section 110 relative to one another. Each of the second slots 172 may include a base surface 175 recessed below a perimeter face 176 extending around the second end walls 116A-B and the second sidewall 120. Similarly, the second ridges 174 are generally L-shaped and located on opposite corners of the second section 110 relative to one another. Each of the second ridges 174 may extend outwardly from the perimeter face 176 and towards the first section 108 of the housing 104. As shown, each of the second end walls 116A-B and the second sidewall 120 have a second inner surface 177 and a second outer surface 178, wherein the second slots 172 and the second ridges 174 extend between the second inner surface 177 and the second outer surface 178. Said another way, a plane defined by the second inner surface 177 and a plane defined by the second outer surface 178 may be oriented parallel, or substantially parallel to the second slots 172 and the second ridges 174.

During coupling of the first section 108 and the second section 110, the first ridge(s) 164 extends into the second slot(s) 172, and the second ridge 174 extends into the first slot 162. The slots and ridges may be dimensioned to fit snugly together. In an exemplary embodiment, the first section 108 and the second section 110 are identical or substantially identical, thus allowing the two halves of the housing 104 to fit together in a complimentary arrangement.

Figure 5:
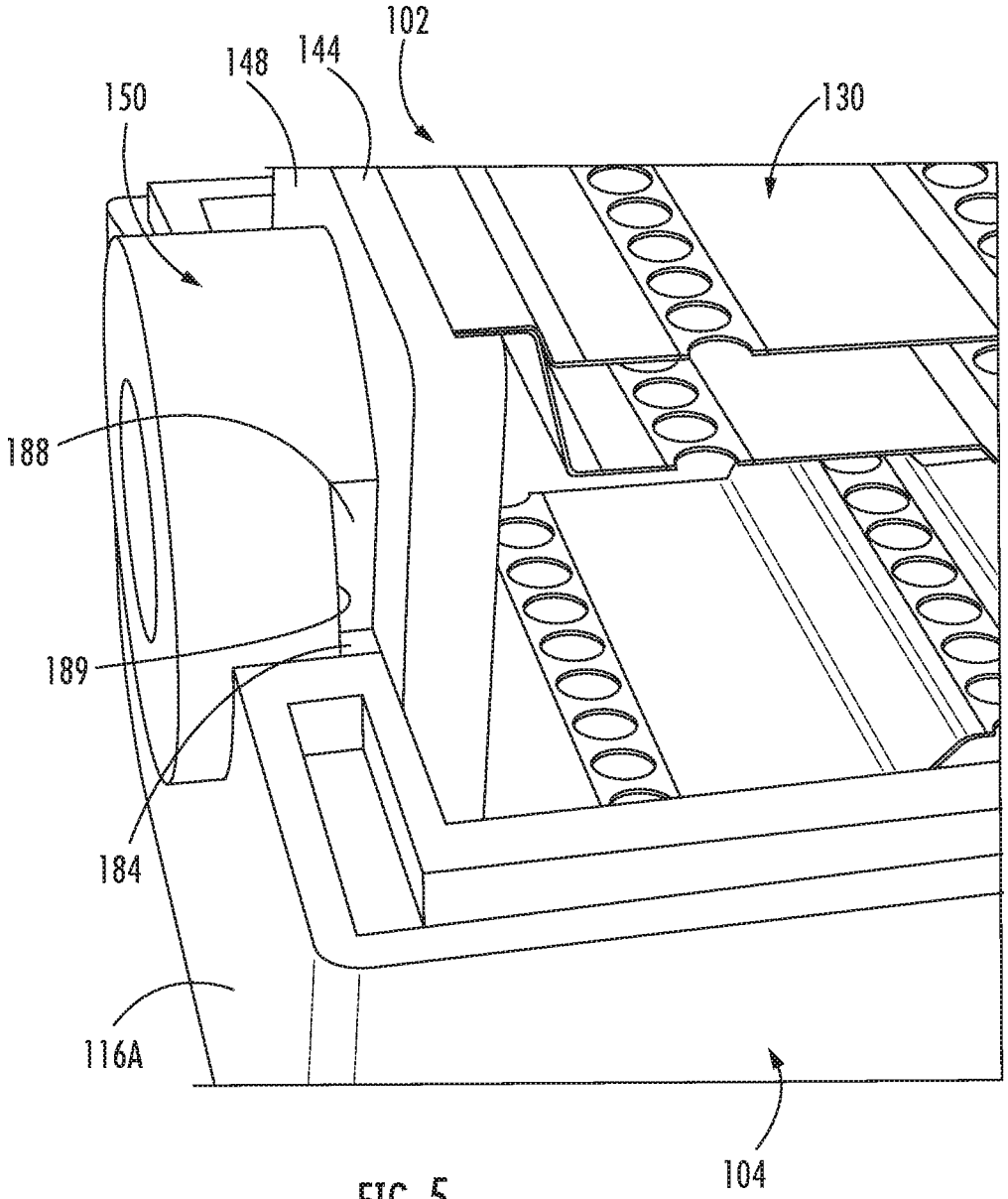
FIG. 5 is a perspective view of a portion of the fuse assembly of FIG. 1 in accordance with embodiments of the present disclosure.

As further shown, the first end walls 112A-B include one or more first opening tabs 180 extending along a perimeter 181 of the first set of openings 122. Similarly, the second end walls 116A-B include one or more second opening tabs 184 extending from a perimeter 185 of the second set of openings 124. As shown in FIG. 5, the first and/or second opening tabs 180, 184 extend into a side slot 188 of the end section 150 of the core 102. In some embodiments, the side slot 188 may be flattened recess defining an engagement surface 189 that faces the external surface 148 of the block section 144 of the core 102. The engagement surface 189 and the external surface 148 engage or abut the first and second opening tabs 180, 184 to secure the core 102 in place within the housing 104. More specifically, the first and second opening tabs 180, 184 prevent of the core 102 from being pushed into the housing 104, while the engagement surface 189 prevents rotation of the core 102.

In some embodiments, the first section 108 and the second section 110 are additionally secured together using one or more of the following non-limiting examples: an epoxy, a strap mechanically binding the halves together, a metal through post that may be inserted and then deforming at its ends, a metal clip or clasp, or by sonic welding. It will be appreciated that other approaches for securing the first section 108 and the second section 110 together are possible within the scope of the present disclosure.

While the present disclosure has been described with reference to certain approaches, numerous modifications, alterations and changes to the described approaches are possible without departing from the sphere and scope of the present disclosure, as defined in the appended claims. Accordingly, it is intended that the present disclosure not be limited to the described approaches, but that it has the full scope defined by the language of the following claims, and equivalents thereof. While the disclosure has been described with reference to certain approaches, numerous modifications, alterations and changes to the described approaches are possible without departing from the spirit and scope of the disclosure, as defined in the appended claims. Accordingly, it is intended that the present disclosure not be limited to the described approaches, but that it has the full scope defined by the language of the following claims, and equivalents thereof.

The invention claimed is:

1. A fuse assembly comprising:

a core including a set of fusible elements extending between a first end fitting and a second end fitting; and a housing surrounding the core, the housing comprising:

a first section having a first end wall and a first sidewall defining a first internal cavity, wherein a first L-shaped slot is formed in adjoining edges of first end wall and the first sidewall, and wherein a first L-shaped ridge extends from adjoining edges of first end wall and the first sidewall; and a second section coupled to the first section, the second section having a second end wall and a second sidewall defining a second internal cavity, wherein a second L-shaped slot is formed in adjoining edges of second end wall and the second sidewall, and wherein a second L-shaped ridge extends from adjoining edges of second end wall and the second sidewall, wherein the first L-shaped slot engages the second L-shaped ridge and the second L-shaped slot engages the first L-shaped ridge.

2. The fuse assembly according to claim 1, wherein the first section includes a first set of openings through the first end wall, wherein the second section includes a second set of openings through the second end wall, and wherein the first set of openings are aligned with the second set of openings.

3. The fuse assembly according to claim 2, wherein the first end wall includes a first opening tab extending along a perimeter of the first set of openings, and wherein the second end wall includes a second opening tab extending along a perimeter of the second set of openings, wherein the first opening tab minimizes movement of the first end fitting towards the first and second internal cavities of the housing, and wherein the second opening tab minimizes movement of the second end fitting towards the first and second internal cavities of the housing.

4. The fuse assembly according to claim 3, each of the first end fitting and the second end fitting comprising:

a block section having an internal surface and an external surface; and an end section extending from the external surface of the block section, the end section extending through the first set of openings through the first end wall and the second set of openings through the second end wall.

5. The fuse assembly according to claim 4, wherein the end section includes a side slot defining an engagement surface, and wherein the engagement surface faces the external surface of the block section.

6. The fuse assembly according to claim 5, wherein the engagement surface is in abutment with the first opening tab and the second opening tab for coupling the core to the housing and for minimizing rotation of the core relative to the housing.

7. The fuse assembly according to claim 4, wherein the block section includes a perimeter surface, and wherein a connector element of the set of fusible elements is directly coupled to the perimeter surface.

8. The fuse assembly according to claim 1, wherein the first sidewall has a first inner surface and a first outer surface, and wherein the first L-shaped slot and the first L-shaped ridge extend between the first inner surface and the first outer surface.

9. The fuse assembly according to claim 8, wherein the second sidewall has a second inner surface and a second outer surface, and wherein the second L-shaped slot and the second L-shaped ridge extend between the second inner surface and the second outer surface.

10. The fuse assembly according to claim 1, wherein the first section is substantially identical to the second section.

11. A square-body fuse comprising:

a core including a set of fusible elements extending between a first end fitting and a second end fitting; and a housing surrounding the core such that the set of fusible elements are contained within the housing and the first and second end fittings extend partially outside of the housing, the housing comprising:

a first section having a first end wall and a first sidewall defining a first internal cavity, wherein a first L-shaped slot is formed in adjoining edges of first end wall and the first sidewall, and wherein a first L-shaped ridge extends from adjoining edges of first end wall and the first sidewall; and a second section coupled to the first section, the second section having a second end wall and a second side wall defining a second internal cavity, wherein a second L-shaped slot is formed in adjoining edges of second end wall and the second sidewall, and wherein a second L-shaped ridge extends from adjoining edges of second end wall and the second sidewall, wherein the first L-shaped ridge extends into the second L-shaped slot and the second L-shaped ridge extends into the first L-shaped slot.

12. The square-body fuse according to claim 11, each of the first end fitting and the second end fitting comprising:

a block section having an internal surface and an external surface; and an end section extending from the external surface of the block section, the end section extending through a first set of openings through the first end wall and a second set of openings through the second end wall, wherein the end section includes a side slot defining an engagement surface facing the external surface of the block section, the engagement surface in abutment with an opening tab to couple the core to the housing and to minimize rotation of the core relative to the housing.

* * * * *